US006402301B1

(12) United States Patent
Powers et al.

(10) Patent No.: US 6,402,301 B1
(45) Date of Patent: Jun. 11, 2002

(54) INK JET PRINTHEADS AND METHODS THEREFOR

(75) Inventors: James Harold Powers, Lexington; Carl Edmond Sullivan, Versailles, both of KY (US)

(73) Assignee: Lexmark International, Inc, Lexington, KY (US)

( * ) Notice: Subject to any disclaimer, the term of this patent is extended or adjusted under 35 U.S.C. 154(b) by 25 days.

(21) Appl. No.: 09/698,765

(22) Filed: Oct. 27, 2000

(51) Int. Cl.[7] ..... B41J 2/05
(52) U.S. Cl. ..... 347/63
(58) Field of Search ..... 347/63, 56, 64, 347/61, 54, 85, 93, 20, 29; 216/27, 4, 48; 29/890.1; 430/311

(56) References Cited

U.S. PATENT DOCUMENTS

| | | | |
|---|---|---|---|
| 3,958,255 | A | 5/1976 | Chiou et al. |
| 4,059,480 | A | 11/1977 | Ruh et al. |
| 4,066,491 | A | 1/1978 | Ruh et al. |

(List continued on next page.)

FOREIGN PATENT DOCUMENTS

| | | | |
|---|---|---|---|
| DE | 19847455 | | 4/2000 |
| EP | 0838337 | A1 | 4/1998 |
| EP | 0838839 | A2 | 4/1998 |

(List continued on next page.)

OTHER PUBLICATIONS

Kamisuki, S., M. Fujii, T. Takekoshi, C. Tezuka and M. Atobe, "A High Resolution, Electrostatically–Driven Commercial Inkjet Head," Seiko Epson Corporation (Nagano, Japan).*

Klaassen, Erno H., Jitendra Mohan, Kurt E. Petersen, Nadim I. Maluf, Joe Brown, Christopher W. Storment, John Logan, Wendell McCulley and Gregory T. A. Kovacs, MEMS Devices Through Deep Reactive Ion Etching of Single–Crystal Silicon, http://transducers.stanford.edu/stl/Project/mems.html, Electrical Engineering Department, Integrated Circuits Lab, Stanford University; Cepheid, Inc.; Lucas NovaSensor.*

MIMEC, "A study of the performance of cryogenically cooled, high density plasma sources for etching silicon using SF6/O2–based chemistry," http://www.el.utwente.nl/tdm/mmd/projects/droog/study.htm, MICMEC Home Research Education Group.*

Oxford Plasma Technology, "InP Via Hole Etching for MMIC fabrication Oxford Plasma Technology," http://www.oxfordplasma.de/plasma/mp via.htm.*

MCNC MEMS Technology Applications Center, "Deep Si RIE Processing," mems@memsrus.com formerly http://mems.mcnc.org/.*

(List continued on next page.)

*Primary Examiner*—Raquel Yvette Gordon
(74) *Attorney, Agent, or Firm*—David E. LaRose; Luedeka, Neely & Graham

(57) ABSTRACT

The invention provides a method for making ink feed vias in semiconductor silicon substrate chips for an ink jet printhead and ink jet printheads containing silicon chips made by the method. The method includes applying an etch stop layer to a first surface of the silicon chip having a thickness ranging from about 300 to about 800 microns, dry etching individual ink vias through the thickness of the silicon chip up to the etch stop layer from a surface opposite the first surface and forming holes in the etch stop layer to individually fluidly connect with the ink vias using a mechanical technique. Substantially vertical wall vias are etched through the thickness of the silicon chip using the method. As opposed to conventional ink via formation techniques, the method significantly improves the throughput of silicon chip and reduces losses due to chip breakage and cracking. The resulting chips are more reliable for long term printhead use.

34 Claims, 3 Drawing Sheets

U.S. PATENT DOCUMENTS

| | | | |
|---|---|---|---|
| 4,717,448 | A | 1/1988 | Cox et al. |
| 4,789,425 | A | 12/1988 | Drake et al. |
| 4,822,755 | A | 4/1989 | Hawkins et al. |
| 4,863,560 | A | 9/1989 | Hawkins |
| 4,894,664 | A | 1/1990 | Tsung Pan |
| 4,983,253 | A | 1/1991 | Wolfe et al. |
| 4,985,710 | A | 1/1991 | Drake et al. |
| 5,007,982 | A | 4/1991 | Tsou |
| 5,277,755 | A | 1/1994 | O'Neill |
| 5,308,442 | A | 5/1994 | Taub et al. |
| 5,316,979 | A | 5/1994 | MacDonald et al. |
| 5,401,318 | A | 3/1995 | Pearson |
| 5,426,070 | A | 6/1995 | Shaw et al. |
| 5,441,593 | A | 8/1995 | Baughman et al. |
| 5,463,411 | A | 10/1995 | Wehl |
| 5,489,930 | A | 2/1996 | Anderson |
| 5,498,312 | A | 3/1996 | Laermer et al. |
| 5,501,893 | A | 3/1996 | Laermer et al. |
| 5,605,603 | A | 2/1997 | Grimard et al. |
| 5,658,472 | A | 8/1997 | Bartha et al. |
| 5,660,680 | A | 8/1997 | Keller |
| 5,751,315 | A | 5/1998 | Burke et al. |
| 5,770,465 | A | 6/1998 | MacDonald et al. |
| 5,804,083 | A | 9/1998 | Ishii et al. |
| 5,867,192 | A | 2/1999 | Mantell et al. |
| 5,914,280 | A | 6/1999 | Gelzinis |
| 5,970,376 | A | 10/1999 | Chen |
| 5,989,445 | A | 11/1999 | Wise et al. |
| 6,019,907 | A | 2/2000 | Kawamura |
| 6,051,503 | A | 4/2000 | Bhardwaj et al. |
| 6,113,221 | A | 9/2000 | Weber |
| 6,137,443 | A | 10/2000 | Beatty et al. |

FOREIGN PATENT DOCUMENTS

| | | | |
|---|---|---|---|
| EP | 0895866 | A2 | 2/1999 |
| EP | 0940257 | A2 | 9/1999 |
| EP | 0895866 | A3 | 3/2000 |
| EP | 0940257 | A3 | 4/2000 |
| EP | 1024007 | A1 | 8/2000 |
| EP | 1078755 | A1 | 2/2001 |
| JP | 11-028820 | A | 2/1999 |
| WO | WO 98/51506 | | 11/1988 |
| WO | WO 99/01887 | A1 | 1/1999 |
| WO | WO 99/65065 | A1 | 12/1999 |
| WO | WO 00/0354 | A1 | 1/2000 |
| WO | WO 00/05749 | A2 | 2/2000 |
| WO | WO 00/26956 | A1 | 5/2000 |

OTHER PUBLICATIONS

MCNC MEMS Technology Applications Center, "Deep Si RIE TechNet Modules," mems@memsrus.com formerly http://mems.mcnc.org/.*

AMMI, "Total MEMS Solutions™" Advanced MicroMachines for Industry, http://www.memslink.com/cpblties/.*

* cited by examiner

View A-A

INK JET PRINTHEADS AND METHODS THEREFOR

FIELD OF THE INVENTION

The invention is directed to printheads for ink jet printers and more specifically to improved printhead structures and methods for making the structures.

BACKGROUND

Ink jet printers continue to be improved as the technology for making the printheads continues to advance. New techniques are constantly being developed to provide low cost, highly reliable printers which approach the speed and quality of laser printers. An added benefit of ink jet printers is that color images can be produced at a fraction of the cost of laser printers with as good or better quality than laser printers. All of the foregoing benefits exhibited by ink jet printers have also increased the competitiveness of suppliers to provide comparable printers in a more cost efficient manner than their competitors.

One area of improvement in the printers is in the print engine or printhead itself. This seemingly simple device is a microscopic marvel containing electrical circuits, ink passageways and a variety of tiny parts assembled with precision to provide a powerful, yet versatile component of the printer. The printhead components must also cooperate with an endless variety of ink formulations to provide the desired print properties. Accordingly, it is important to match the printhead components to the ink and the duty cycle demanded by the printer. Slight variations in production quality can have a tremendous influence on the product yield and resulting printer performance.

An ink jet printhead includes a semiconductor chip and a nozzle plate attached to the chip. The semiconductor chip is typically made of silicon and contains various passivation layers, conductive metal layers, resistive layers, insulative layers and protective layers deposited on a device surface thereof. The individual heater resistors are defined in the resistive layers and each heater resistor corresponds to a nozzle hole in the nozzle plate for heating and ejecting ink toward a print media. In one form of a printhead, the nozzle plates contain ink chambers and ink feed channels for directing ink to each of the heater resistors on the semiconductor chip. In a center feed design, ink is supplied to the ink channels and ink chambers from a slot or single ink via which is conventionally formed by chemically etching or grit blasting through the thickness of the semiconductor chip.

Grit blasting the semiconductor chip to form ink vias is a preferred technique because of the speed with which chips can be made by this technique. However, grit blasting results in a fragile product and often times creates microscopic cracks or fissures in the silicon substrate which eventually lead to chip breakage and/or failure. Furthermore, grit blasting cannot be adapted on an economically viable production basis for forming substantially smaller holes in the silicon substrate or holes having the desired dimensional parameters for the higher resolution printheads. Another disadvantage of grit blasting is the sand and debris generated during the blasting process which is a potential source of contamination and the grit can impinge on electrical components on the chips causing electrical failures.

Wet chemical etching techniques may provide better dimensional control for etching of relatively thin semiconductor chips than grit blasting techniques. However, as the thickness of the wafer approaches 200 microns, tolerance difficulties increase significantly. In wet chemical etching, dimensions of the vias are controlled by a photolithographic masking process. Mask alignment provides the desired dimensional tolerances. The resulting ink vias have smooth edges which are free of cracks or fissures. Hence the chip is less fragile than a chip made by a grit blasting process. However, wet chemical etching is highly dependent on the thickness of the silicon chip and the concentration of the etchant which results in variations in etch rates and etch tolerances. The resulting etch pattern for wet chemical etching must be at least as wide as the thickness of the wafer. Wet chemical etching is also dependent on the silicon crystal orientation and any misalignment relative to the crystal lattice direction can greatly affect dimensional tolerances. Mask alignment errors and crystal lattice registration errors may result in significant total errors in acceptable product tolerances. Wet chemical etching is not practical for relatively thick silicon substrates because the entrance width is equal to the exit width plus the square root of 2 times the substrate thickness when using KOH and (100) silicon. Furthermore, the tolerances required for wet chemical etching are often too great for small or closely spaced holes because there is always some registration error with respect to the lattice orientation resulting in relatively large exit hole tolerances.

As advances are made in print quality and speed, a need arises for an increased number of heater resistors which are more closely spaced on the silicon chips. Decreased spacing between the heater resistors requires more reliable ink feed techniques for the individual heater resistors. As the complexity of the printheads continues to increase, there is a need for long-life printheads which can be produced in high yield while meeting more demanding manufacturing tolerances. Thus, there continues to be a need for improved manufacturing processes and techniques which provide improved printhead components.

SUMMARY OF THE INVENTION

With regard to the above and other objects the invention provides a method for making ink feed vias in semiconductor silicon substrate chips for an ink jet printhead. The method includes applying an etch stop layer to a first surface of the silicon chip having a thickness ranging from about 300 to about 800 microns, dry etching one or more ink vias through the thickness of the silicon chip up to the etch stop layer from a surface opposite the first surface and forming one or more through holes in the etch stop layer by a mechanical technique each through hole corresponding to a via of the one or more vias in order to fluidly connect the one or more through holes with the corresponding ink vias. Substantially vertical wall vias are etched through the thickness of the silicon chip using the method.

In another aspect the invention provides a silicon chip for an ink jet printhead. The silicon chip includes a device layer and a substrate layer, the device layer having a thickness ranging from about 1 to about 4 microns and the substrate layer having a thickness ranging from about 300 to about 800 microns. The device layer has an exposed surface containing a plurality of heater resistors defined by conductive, resistive, insulative and protective layers deposited on the exposed surface thereof. The silicon chip also includes at least one ink feed via corresponding to one or more heater resistors, the ink feed via being formed by dry etching through the substrate layer and having at least one through hole corresponding to each via opened by mechanical means in the device so that the at least one through hole individually fluidly connects with the corresponding ink feed via.

An advantage of the invention is that one or more ink via holes may be formed in a semiconductor silicon chip which meet demanding tolerances and provide improved ink flow to one or more heater resistors. Unlike grit blasting techniques, the ink vias are formed without introducing unwanted stresses or microscopic cracks in the semiconductor chips. Grit blasting is not readily adaptable to forming relatively narrow ink vias because the tolerances for grit blasting are too large or to forming a large number of individual ink vias in a semiconductor chip because each via must be bored one at a time. Deep reactive ion etching (DRIE) and inductively coupled plasma (ICP) etching, referred to herein as "dry etching", also provide advantages over wet chemical etching techniques because the etch rate is not dependent on silicon thickness or crystal orientation. Dry etching techniques are also adaptable to producing a larger number of ink vias which may be more closely spaced to corresponding heater resistors than ink vias made with conventional wet chemical etching and grit blasting processes.

BRIEF DESCRIPTION OF THE DRAWINGS

Further advantages of the invention will become apparent by reference to the detailed description when considered in conjunction with the figures, which are not to scale, wherein like reference numbers indicate like elements through the several views, and wherein.

DETAILED DESCRIPTION OF THE INVENTION

Figure 1:
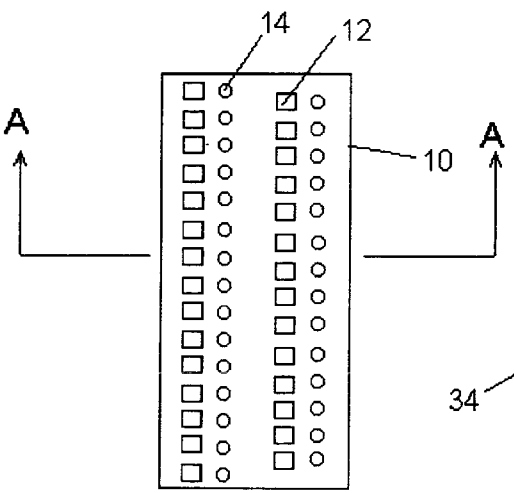
FIG. 1 is a top plan view of a portion of a semiconductor chip showing the arrangement of ink vias and heater resistors according to one aspect of the invention.

With reference to FIG. 1, the invention provides a semiconductor silicon chip 10 having a device side containing a plurality of heater resistors 12 and a plurality of ink feed vias 14 therein corresponding to one or more of the heater resistors 12. The semiconductor chips 10 are relatively small in size and typically have overall dimensions ranging from about 2 to about 10 millimeters wide by about 10 to about 36 millimeters long. In conventional semiconductor chips containing slot-type ink vias which are grit blasted in the chips 10, the ink via slots have dimensions of about 9.7 millimeters long and 0.39 millimeters wide. Accordingly, the chips 10 must have a width sufficient to contain the relative wide ink via while considering manufacturing tolerances, and sufficient surface area for heater resistors and connectors. In the chips made according to the invention, the ink via holes 14 have a diameter or length and width ranging from about 5 microns to about 200 microns thereby substantially reducing the amount of chip surface area required for the ink vias, heater resistors and connecting circuits. Reducing the size of the chips 10 enables a substantial increase in the number of chips 10 that may be obtained from a single silicon wafer. Hence, the invention provides substantial incremental cost savings over chips made by conventional techniques containing slot type ink vias.

The ink feed vias 14 are etched through the entire thickness of the semiconductor substrate 10 and are in fluid communication with ink supplied from an ink supply container, ink cartridge or remote ink supply. The ink vias 14 direct ink from the ink supply container which is located opposite the device side of the silicon chip 10 through the chip 10 to the device side of the chip as seen in the plan view in FIG. 1. The device side of the chip 10 also preferably contains electrical tracing from the heater resistors to contact pads used for connecting the chip to a flexible circuit or TAB circuit for supplying electrical impulses from a printer controller to activate one or more heater resistors.

Figure 1A:
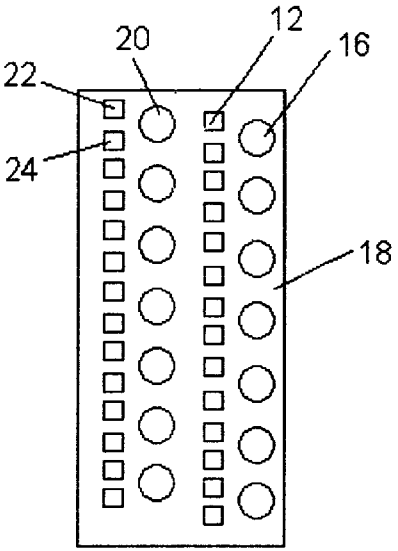
FIG. 1A is a top plan view of a portion of a semiconductor chip showing an alternate arrangement of ink vias and heater resistors according to the invention.

In FIG. 1, a single ink via 14 is associated with a single heater resistor 12. Accordingly, there are as many ink vias 14 as heater resistors 12 on the chip 10. An alternative arrangement of ink vias 14 and heater resistors 12 is shown in FIG. 1A. In this example, ink vias 16 are substantially larger than the ink vias 14 of FIG. 1. Each ink via 16 of chip 18 in FIG. 1A is associated with two or more heater resistors 12. For example, ink via 20 is associated with heater resistors 22 and 24. In yet another embodiment, there is one ink via for feeding ink to four or more adjacent heater resistors.

Figure 2:
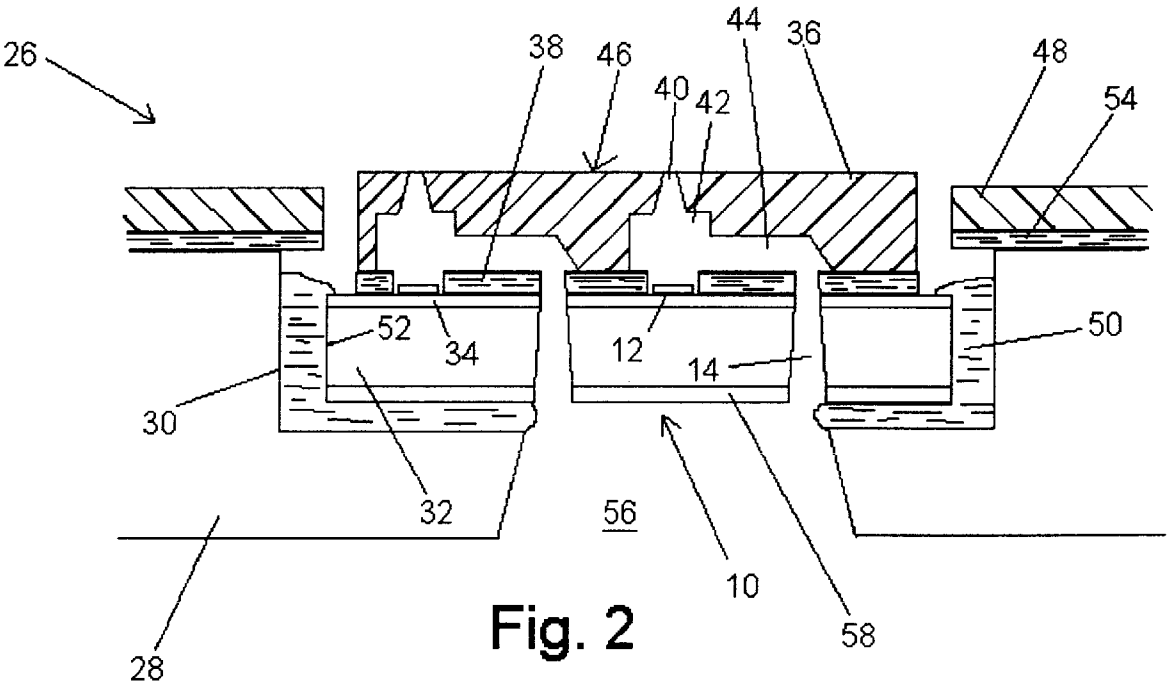
FIG. 2 is a cross-sectional view, not to scale of a portion of a printhead for an ink jet printer.

A cross-sectional view, not to scale of a portion of a printhead 26 containing the semiconductor silicon chip of FIGS. 1 or 1A is illustrated in FIG. 2. As seen in FIG. 2, the printhead includes a chip carrier or cartridge body 28 having a recess or chip pocket 30 therein for attachment of a silicon chip 10 (FIG. 1) thereto, the chip having a substrate layer 32 and a device layer 34. The device layer 34 is preferably an etch stop layer of silicon dioxide ($SiO_2$) which will be described in more detail below. Alternative etch stop materials which may be used instead of or in addition to silicon dioxide include resists, metals, metal oxides and other known etch stop materials. The heater resistors 12 are formed on the device layer 34 by well known semiconductor manufacturing techniques.

After forming ink vias 14 and depositing resistive, conductive, insulative and protective layers on device layer 34, a nozzle plate 36 is attached to the device layer 34 side of the chip 10 by means of one or more adhesives such as adhesive 38 which may be a UV-curable or heat curable epoxy material. Adhesive 38 is preferably a heat curable adhesive such as a B-stageable thermal cure resin, including, but not limited to phenolic resins, resorcinol resins, epoxy resins, ethylene-urea resins, furane resins, polyurethane resins and silicone resins. The adhesive 38 is preferably cured before attaching the chip 10 to the chip carrier or cartridge body 28 and adhesive 38 preferably has a thickness ranging from about 1 to about 25 microns. A particularly preferred adhesive 38 is a phenolic butyral adhesive which is cured by heat and pressure.

The nozzle plate 36 contains a plurality of nozzle holes 40 each of which are in fluid flow communication with an ink chamber 42 and an ink supply channel 44 which are formed in the nozzle plate material by means such as laser ablation.

A preferred nozzle plate material is polyimide which may contain an ink repellent coating on surface 46 thereof Alternatively ink supply channels may be formed independently of the nozzle plate in a layer of photoresist material applied and patterned by methods known to those skilled in the art.

The nozzle plate 36 and semiconductor chip 10 are preferably aligned optically so that the nozzle holes 40 in the nozzle plate 36 align with heater resistors 12 on the semiconductor chip 10. Misalignment between the nozzle holes 40 and the heater resistor 12 may cause problems such as misdirection of ink droplets from the printhead 26, inadequate droplet volume or insufficient droplet velocity. Accordingly, nozzle plate/chip assembly 36/10 alignment is critical to the proper functioning of an ink jet printhead. As seen in FIG. 2, the ink vias 14 are also preferably aligned with the ink channels 44 so that ink is in flow communication with the ink vias 14, channels 44 and ink chambers 42.

After attaching the nozzle plate 36 to the chip 10, the semiconductor chip 10 of the nozzle plate/chip assembly 36/10 is electrically connected to the flexible circuit or TAB circuit 48 using a TAB bonder or wires to connect traces on the flexible or TAB circuit 48 with connection pads on the semiconductor chip 10. Subsequent to curing adhesive 38, the nozzle plate/chip assembly 36/10 is attached to the chip carrier or cartridge body 28 using a die bond adhesive 50. The nozzle plate/chip assembly 36/10 is preferably attached to the chip carrier or cartridge body 28 in the chip pocket 30. Adhesive 50 seals around the edges 52 of the semiconductor chip 10 to provide a substantially liquid tight seal to inhibit ink from flowing between edges 52 of the chip 10 and the chip pocket 30.

The die bond adhesive 50 used to attach the nozzle plate/chip assembly 36/10 to the chip carrier or cartridge body 28 is preferably an epoxy adhesive such as a die bond adhesive available from Emerson & Cuming of Monroe Township, N.J. under the trade name ECCOBOND 3193-17. In the case of a thermally conductive chip carrier or cartridge body 28, the die bond adhesive 50 is preferably a resin filled with thermal conductivity enhancers such as silver or boron nitride. A preferred thermally conductive die bond adhesive 50 is POLY-SOLDER LT available from Alpha Metals of Cranston, R.I. suitable die bond adhesive 50 containing boron nitride fillers is available from Bryte Technologies of San Jose, Calif. under the trade designation G0063. The thickness of adhesive 50 preferably ranges from about 25 microns to about 125 microns. Heat is typically required to cure adhesive 50 and fixedly attach the nozzle plate/chip assembly 36/10 to the chip carrier or cartridge body 28.

Once the nozzle plate/chip assembly 36/10 is attached to the chip carrier or cartridge body 28, the flexible circuit or TAB circuit 48 is attached to the chip carrier or cartridge body 28 using a heat activated or pressure sensitive adhesive 54. Preferred pressure sensitive adhesives 54 include, but are not limited to phenolic butyral adhesives, acrylic based pressure sensitive adhesives such as AEROSET 1848 available from Ashland Chemicals of Ashland, Ky. and phenolic blend adhesives such as SCOTCH WELD 583 available from 3M Corporation of St. Paul, Minn. The adhesive 54 preferably has a thickness ranging from about 25 to about 200 microns.

In order to control the ejection of ink from the nozzle holes 40, each semiconductor chip 10 is electrically connected to a print controller in the printer to which the printhead 10 is attached. Connections between the print controller and the heater resistors 12 of printhead 10 are provided by electrical traces which terminate in contact pads in the device layer 34 of the chip 10. Electrical TAB bond or wire bond connections are made between the flexible circuit or TAB circuit 48 and the contact pads on the semiconductor substrate 10.

During a printing operation, an electrical impulse is provided from the printer controller to activate one or more of the heater resistors 12 thereby heating ink in the ink chamber 42 to vaporize a component of the ink thereby forcing ink through nozzle 40 toward a print media. Ink is caused to refill the ink channel 44 and ink chamber 42 by collapse of the bubble in the ink chamber and capillary action. The ink flows from an ink supply container through an ink feed slot 56 in the chip carrier or cartridge body 28 to the ink feed vias 14 in the chip 10. It will be appreciated that the ink vias 14 made by the methods of the invention as opposed to vias 14 made by grit blasting techniques, provide chips 10 having greater structural integrity and greater placement accuracy. In order to provide chips 10 having greater structural integrity, it is important to form the vias 14 with minimum damage to the semiconductor chip 10.

A preferred method for forming ink vias 14 in a silicon semiconductor chip 10 is a dry etch technique selected from deep reactive ion etching (DRE) and inductively coupled plasma (ICP) etching. Both techniques employ an etching plasma comprising an etching gas derived from fluorine compounds such as sulfur hexafluoride ($SF_6$), tetrafluoromethane ($CF_4$) and trifluoroamine ($NF_3$). A particularly preferred etching gas is $SF_6$. A passivating gas is also used during the etching process. The passivating gas is derived from a gas selected from the group consisting of trifluoromethane ($CHF_3$), tetrafluoroethane ($C_2F_4$), hexafluoroethane ($C_2F_6$), difluoroethane ($C_2H_2F_2$), octofluorobutane ($C_4F_8$) and mixtures thereof. A particularly preferred passivating gas is $C_4F_8$.

In order to conduct dry etching of vias 14 in the silicon semiconductor chip 10, the chip is preferably coated on the device layer 34 surface thereof (FIG. 3) with an etch stop material selected from $SiO_2$, a photoresist material, metal and metal oxides, i.e., tantalum, tantalum oxide and the like. Likewise, the substrate layer 32 is preferably coated on the side opposite the device layer with a protective layer 58 or etch stop material selected from $SiO_2$, a photoresist material, tantalum, tantalum oxide and the like. The $SiO_2$ etch stop layer 34 and/or protective layer 58 may be applied to the silicon chip 10 by a thermal growth method, sputtering or spinning. A photoresist material may be applied to the silicon chip 10 as a protective layer 58 or etch stop layer 34 by spinning the photoresist material on the chip 10.

Device layer 34 is relatively thin compared to the thickness of the substrate layer 32 and will generally have a substrate layer 32 to device layer thickness ratio ranging from about 125:1 to about 800:1. Likewise, protective layer 58 is relatively thin compared to the thickness of the substrate layer 32 and will generally have a substrate layer to protective layer thickness ratio ranging from about 30:1 to about 800:1. Accordingly, for a silicon substrate layer 32 having a thickness ranging from 300 to about 800 microns, the device layer 34 thickness may range from about 1 to about 4 microns and the protective layer 58 thickness may range from about 1 to about 30 microns, preferably from about 16 to about 20 microns thick.

The via 14 locations in the chip 10 may be patterned in the chip 10 from either side of the chip 10, the opposite side being provided with an etch stop material such as device layer 34 or protective layer 58. For example, a photoresist layer or $SiO_2$ layer may be applied as protective layer 58. The photoresist layer is patterned to define the location of vias 14 using, for example, ultraviolet light and a photomask.

Figure 3:
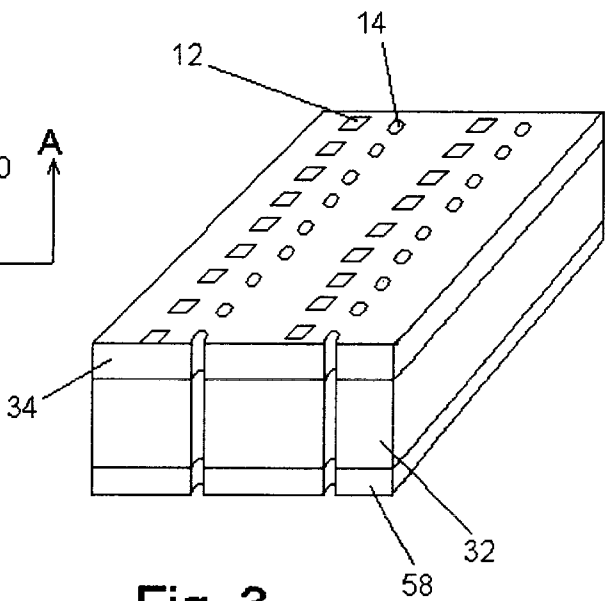
FIG. 3 is a cut away perspective view of a portion of a semiconductor chip according to a first aspect of the invention.

The via 14 locations in the chip 10 of FIG. 3 may also be patterned using a two-step process. In the first step, the vias 14 are opened on the device layer side of the chip 10 with a dry etching technique (or during wafer fabrication). The vias 14 are etched to a depth, preferably less than about 50 microns. The device layer 34 is then coated with a photoresist layer or $SiO_2$ layer and the chip 10 is dry etched from the side opposite the device layer 34 to complete the via 14 through the chip. As a result of the two-step process, the via locations and sizes are even more precise.

The patterned chip or the chip 10 containing the etch stop layer or device layer 34 and protective layer 58 is then placed in an etch chamber having a source of plasma gas and back side cooling such as with helium and water. It is preferred to maintain the silicon chip 10 below about 400° C., most preferably in a range of from about 50° to about 80° C. during the etching process. In the process, a deep reactive ion etch (DRIE) or inductively coupled plasma (ICP) etch of the silicon is conducted using an etching plasma derived from $SF_6$ and a passivating plasma derived from $C_4F_8$ wherein the chip 10 is etched from the protective layer 58 side toward the device layer 34 side.

During the etching process, the plasma is cycled between the passivating plasma step and the etching plasma step until the vias 14 reach the device layer 34. Cycling times for each step preferably ranges from about 5 to about 20 seconds for each step. Gas pressure in the etching chamber preferably ranges from about 15 to about 50 millitorrs at a temperature ranging from about −20° to about 35° C. The DRIE or ICP platen power preferably ranges from about 10 to about 25 watts and the coil power preferably ranges from about 800 watts to about 3.5 kilowatts at frequencies ranging from about 10 to about 15 MHz. Etch rates may range from about 2 to about 10 microns per minute or more and produce holes having side wall profile angles ranging from about 88° to about 92°. Etching apparatus is available from Surface Technology Systems, Ltd. of Gwent, Wales. Procedures and equipment for etching silicon are described in European Application No. 838,839A2 to Bhardwaj, et al., U.S. Pat. No. 6,051,503 to Bhardwaj, et al., PCT application WO 00/26956 to Bhardwaj, et al.

When the etch stop layer $SiO_2$ is reached, etching of the vias 14 terminates. Holes may be formed in the device layer 34 to connect the holes in fluid communication with the ink vias 14 in chip 10 by blasting through the device layer 34 in the location of the ink vias 14 using a high pressure water wash in a wafer washer. The finished chip 10 preferably contains vias 14 which are located in the chip 10 so that vias 14 are a distance ranging from about 40 to about 60 microns from their respective heaters 12 on device layer 34. The ink vias 14 may be individually associated with each heater resistor 12 on the chip 10 or there may be more or fewer ink vias 14 than heater resistors 12. In such case, each ink via 14 will provide ink to a group of heater resistors 12. In a particularly preferred embodiment, ink vias 14 are individual holes or apertures, each hole or aperture being adjacent a corresponding heater resistor 12. Each ink via 14 has a diameter ranging from about 5 to about 200 microns.

Figure 4:
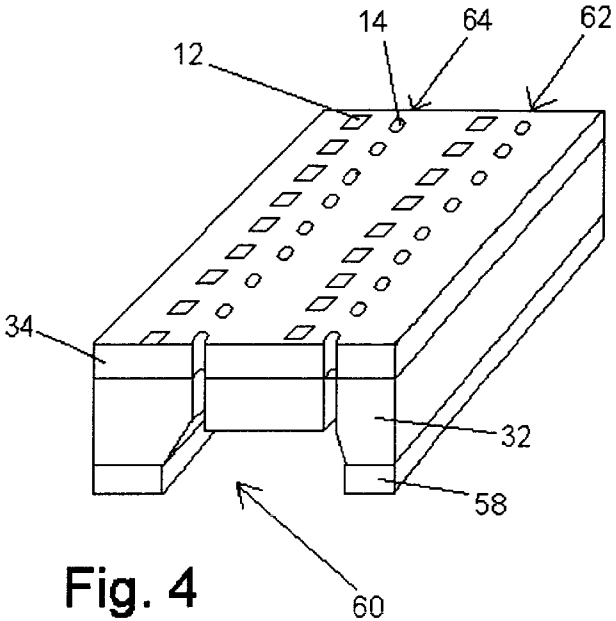
FIG. 4 is a cut away perspective view of a portion of a semiconductor chip according to a second aspect of the invention.

In another embodiment, as shown in FIG. 4, a wide trench 60 may be formed in the back side or substrate layer 32 side of the chip 10 by chemically etching the silicon substrate prior to or subsequent to forming vias 14 in the chip 10. Chemical etching of trench 60 may be conducted using KOH, hydrazine, ethylenediamine-pyrocatechol-$H_2O$ (EDP) or tetramethylammonium hydroxide (TMAH) and conventional chemical etching techniques. Prior to or subsequent to forming trench 60, vias 14 are etched in the silicon chip 10 from the device layer 34 side or from the protective layer 58 side as described above. Trench 60 may also be formed by DRIE or ICP etching of the chip 10 as described above. When the trench 60 is made by chemical etching techniques, a silicon nitride (SiN) protective layer 58 is preferably used to pattern the trench location in the chip 10. Upon completion of the trench formation, a protective layer 58 of $SiO_2$ or other protective material for dry etching silicon is applied to the substrate layer 32 to protect the silicon material during the dry etch process.

The trench 60 is preferably provided in chip 10 to a depth of about 50 to about 300 microns or more. The trench 60 should be wide enough to fluidly connect all of the vias 14 in the chip to one another, or separate parallel trenches 60 may be used to connect parallel rows of vias 14 to one another such as a trench for via row 62 and a trench for via row 64. Upon completion of the via 14 formation, it is preferred to remove protective layer 58 from the chip 10.

Figure 7:
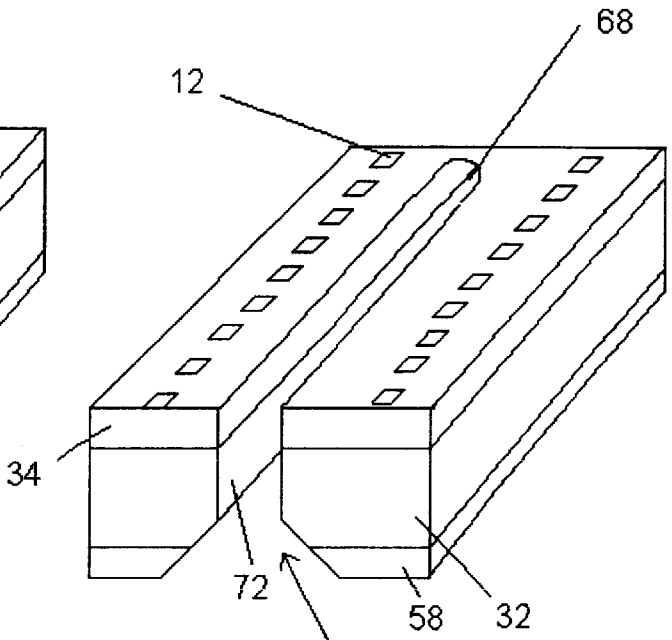
FIG. 7 is a cut away perspective view of a portion of a semiconductor chip according to a fourth aspect of the invention.
Figure 6:
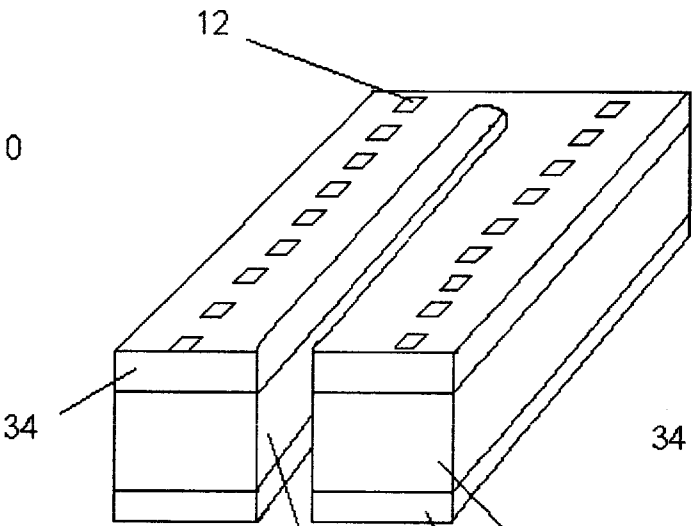
FIG. 6 is a cut away perspective view of a portion of a semiconductor chip according to a third aspect of the invention.
Figure 5:
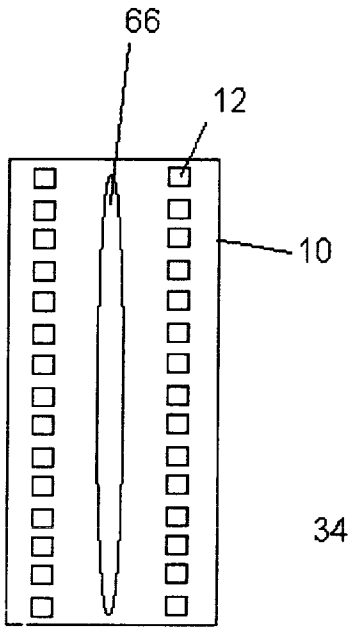
FIG. 5 is a top plan view of a portion of a semiconductor chip according to a third aspect of the invention.

Additional aspects of the invention are illustrated in FIGS. 5–7. In these figures, the vias 66 and 68 are rectangular or oval shaped elongate slots which are adjacent multiple heater resistors 12. The slots 66 and 68 are formed in the semiconductor substrate 10 as described above using DRIE techniques. The ink vias 66 and 68 have substantially vertical walls 70 and 72 and may include a wide trench 74 formed from the back side or substrate layer 32 side of the chip 10 as described above with reference to FIG. 4.

Vias formed by conventional grit blasting techniques typically range from 2.5 mm to 30 mm long and 120 microns to 1 mm wide. The tolerance for grit blast vias is ±60 microns. By comparison, vias formed according to the invention may be made as small as 10 microns long and 10 microns wide. There is virtually no upper limit to the length via that may be formed by DRIE techniques. The tolerance for DRIE vias is about ±10 to about ±15 microns. Any shape via may be made using DRIE techniques according to the invention including round, square, rectangular and oval shaped vias. It is difficult if not impossible to form holes as small as 10 microns in relatively thick silicon chips using grit blasting or wet chemical etching techniques. Furthermore, the vias may be etched from either side of the chip using DRIE techniques according to the invention. A large number of holes or vias 14 may be made at one time rather than sequentially as with grit blasting techniques and at a much faster rate than with wet chemical etching techniques.

Chips 10 having vias 14 formed by the foregoing dry etching techniques are substantially stronger than chips containing vias 14 made by blasting techniques and do not exhibit cracks or fissures which can cause premature failure of printheads containing the chips. The accuracy of via placement is greatly improved by the foregoing process and etch uniformity is greater than about 4%.

As compared to wet chemical etching, the dry etching techniques according to the invention may be conducted independent of the crystal orientation of the silicon chip 10 and thus may be placed more accurately in the chips 10. While wet chemical etching is suitable for chip thickness of less than about 200 microns, the etching accuracy is greatly diminished for chip thicknesses greater than about 200 microns. The gases used for DRIE techniques according to the invention are substantially inert whereas highly caustic chemicals are used for wet chemical etching techniques. The shape of the vias made by DRIE is essentially unlimited whereas the via shape made by wet chemical etching is dependent on crystal lattice orientation. For example in a (100) silicon chip, KOH will typically only etch squares and rectangles without using advance compensation techniques. The crystal lattice does not have to be aligned for DRIE techniques according to the invention.

A comparison of the strength of dry etched silicon chips made according to the invention and grit blasted silicon chips is contained in the following tables. In the following tables, multiple samples were prepared using grit blast and DRIE techniques to provide vias in silicon chips. The vias in each set of samples was intended to be approximately the same width and length on the device side and on the blank side. The "Avg. Edge of Chip to Via" measurements indicated in the tables are taken from the edge of the chip to the edge of the via taken along the length axis of the via The "Avg. Via Width" measurements are taken at approximately the same point across each via along parallel with the width axis of the via.

For the torsion test, a torsion tester was constructed having one end of the tester constructed with a rotating moment arm supported by a roller bearing. A slotted rod for holding the chip was connected to one end of the moment arm. The chip was held on its opposite end by a stationary slotted rod attached to the fixture. A TEFLON indenter was connected to the load cell in the test frame and used to contact the moment arm. A TEFLON indenter was used to reduce any added friction from the movement of the indenter down the moment arm as the arm rotated. The crosshead speed used was 0.2 inches per minute (5.08 mm/min.) and the center of the moment arm to the indenter was 2 inches (50.8 mm).

For the three-point bend test a modified three-point bend fixture was made. The rails and knife edges were polished smooth with a 3 micron diamond paste to prevent any surface defects of the fixture from causing a stress point on the chip samples. The rails of the tester had a span of 3.5 mm and the radius of the rails and knife edges used was about 1 mm. The samples were placed on the fixture and aligned visually with the ink via in the center of the lower support containing the rails and directly below the knife edge. The crosshead speed was 0.5 inches per minute (1.27 mm/min.) and all of the samples were loaded to failure.

TABLE 1

| Sample # | Avg. Via Width (mm) | Via Length (mm) | Avg. Edge of Chip to Via (mm) | Via type | Torsion Strength (lbs) |
|---|---|---|---|---|---|
| 1 | 0.5115 | 13.853 | 1.5455 | DRIE | 0.234 |
| 2 | 0.5075 | 13.863 | 1.5375 | DRIE | 0.301 |
| 3 | 0.4980 | 13.866 | 1.5383 | DRIE | 0.161 |
| 4 | 0.5162 | 13.867 | 1.5435 | DRIE | 0.249 |
| 5 | 0.5298 | 13.866 | 1.5400 | DRIE | 0.177 |
| 6 | 0.5237 | 13.906 | 1.5063 | DRIE | 0.354 |
| 7 | 0.5130 | 13.855 | 1.5455 | DRIE | 0.201 |
| 8 | 0.4978 | 13.855 | 1.5420 | DRIE | 0.288 |
| 9 | 0.5262 | 13.857 | 1.5410 | DRIE | 0.189 |
| 10 | 0.5240 | 13.883 | 1.5320 | DRIE | 0.211 |
| 11 | 0.5175 | 13.862 | 1.5430 | DRIE | 0.325 |
| 12 | 0.5118 | 13.886 | 1.5327 | DRIE | 0.289 |
| 13 | 0.5115 | 13.876 | 1.5360 | DRIE | 0.178 |
| 14 | 0.5137 | 13.902 | 1.5265 | DRIE | 0.373 |
| 15 | 0.5225 | 13.915 | 1.5247 | DRIE | 0.270 |
| 16 | 0.5165 | 13.918 | 1.5775 | DRIE | 0.301 |

TABLE 1-continued

| Sample # | Avg. Via Width (mm) | Via Length (mm) | Avg. Edge of Chip to Via (mm) | Via type | Torsion Strength (lbs) |
|---|---|---|---|---|---|
| 17 | 0.5188 | 13.867 | 1.5403 | DRIE | 0.271 |
| 18 | 0.5115 | 13.893 | 1.5368 | DRIE | 0.506 |
| 19 | 0.5153 | 13.876 | 1.5315 | DRIE | 0.276 |
| 20 | 0.5127 | 13.825 | 1.5308 | DRIE | 0.356 |
| Average Torsion Strength (lbs) for DRIE vias | | | | | 0.2755 |
| 21 | 0.5002 | 13.787 | 1.5470 | Grit blast | 0.139 |
| 22 | 0.4875 | 13.796 | 1.5642 | Grit blast | 0.199 |
| 23 | 0.4793 | 13.770 | 1.5843 | Grit blast | 0.142 |
| 24 | 0.5235 | 13.783 | 1.5605 | Grit blast | 0.233 |
| 25 | 0.4515 | 13.799 | 1.5367 | Grit blast | 0.185 |
| 26 | 0.4950 | 13.792 | 1.5740 | Grit blast | 0.146 |
| 27 | 0.4622 | 13.809 | 1.5290 | Grit blast | 0.210 |
| 28 | 0.4843 | 13.853 | 1.5447 | Grit blast | 0.179 |
| 29 | 0.4700 | 13.862 | 1.5388 | Grit blast | 0.067 |
| 30 | 0.4848 | 13.863 | 1.5397 | Grit blast | 0.177 |
| 31 | 0.4853 | 13.858 | 1.5297 | Grit blast | 0.220 |
| 32 | 0.4890 | 13.795 | 1.5720 | Grit blast | 0.261 |
| 33 | 0.4553 | 13.762 | 1.5848 | Grit blast | 0.172 |
| 34 | 0.4790 | 13.780 | 1.5775 | Grit blast | 0.244 |
| 35 | 0.4720 | 13.684 | 1.6140 | Grit blast | 0.231 |
| 36 | 0.4872 | 13.834 | 1.5497 | Grit blast | 0.292 |
| 37 | 0.4797 | 13.823 | 1.5302 | Grit blast | 0.161 |
| 38 | 0.5105 | 13.748 | 1.5957 | Grit blast | 0.245 |
| 39 | 0.4687 | 13.745 | 1.5860 | Grit blast | 0.292 |
| 40 | 0.4938 | 13.811 | 1.5525 | Grit blast | 0.124 |
| Average Torsion Strength (lbs) for Grit Blast vias | | | | | 0.1959 |

TABLE 2

| Sample # | Avg. Via Width (mm) | Via Length (mm) | Avg. Edge of Chip to Via (mm) | Via type | 3 Point Bend Strength (lbs) |
|---|---|---|---|---|---|
| 1 | 0.4977 | 13.840 | 1.5740 | DRIE | 22.59 |
| 2 | 0.5035 | 13.819 | 1.6817 | DRIE | 10.95 |
| 3 | 0.5022 | 13.832 | 1.6240 | DRIE | 23.55 |
| 4 | 0.5055 | 13.833 | 1.6630 | DRIE | 28.37 |
| 5 | 0.5035 | 13.833 | 1.6177 | DRIE | 25.85 |
| 6 | 0.5135 | 13.847 | 1.5498 | DRIE | 22.99 |
| 7 | 0.5107 | 13.853 | 1.5385 | DRIE | 22.07 |
| 8 | 0.4932 | 13.855 | 1.5447 | DRIE | 39.90 |
| 9 | 0.5030 | 13.869 | 1.5387 | DRIE | 21.11 |
| 10 | 0.5160 | 13.885 | 1.5280 | DRIE | 25.37 |
| 11 | 0.5245 | 13.855 | 1.5455 | DRIE | 22.39 |
| 12 | 0.5202 | 13.860 | 1.5463 | DRIE | 11.18 |
| 13 | 0.4982 | 13.860 | 1.5370 | DRIE | 24.62 |
| 14 | 0.5152 | 13.869 | 1.5330 | DRIE | 30.30 |
| 15 | 0.5250 | 13.859 | 1.5427 | DRIE | 30.78 |
| 16 | 0.5217 | 13.868 | 1.5363 | DRIE | 32.28 |
| 17 | 0.5240 | 13.851 | 1.5475 | DRIE | 22.22 |
| 18 | 0.4925 | 13.847 | 1.5505 | DRIE | 16.28 |
| 19 | 0.5142 | 13.869 | 1.5388 | DRIE | 17.96 |
| 20 | 0.5250 | 13.895 | 1.5275 | DRIE | 12.77 |
| Average 3 point bend strength (lbs) for DRIE vias | | | | | 23.18 |
| 21 | 0.4967 | 13.834 | 1.5425 | Grit blast | 2.698 |
| 22 | 0.4852 | 13.808 | 1.5475 | Grit blast | 5.808 |
| 23 | 0.4740 | 13.836 | 1.5477 | Grit blast | 4.246 |
| 24 | 0.4907 | 13.838 | 1.5472 | Grit blast | 5.511 |
| 25 | 0.4778 | 13.837 | 1.5500 | Grit blast | 6.556 |
| 26 | 0.4835 | 13.843 | 1.5670 | Grit blast | 4.909 |
| 27 | 0.4695 | 13.826 | 1.5535 | Grit blast | 8.352 |
| 28 | 0.4855 | 13.827 | 1.5548 | Grit blast | 5.288 |
| 29 | 0.4868 | 13.823 | 1.5582 | Grit blast | 4.754 |
| 30 | 0.4570 | 13.695 | 1.6208 | Grit blast | 5.120 |
| 31 | 0.4980 | 13.812 | 1.5618 | Grit blast | 6.358 |
| 32 | 0.4992 | 13.827 | 1.5473 | Grit blast | 4.737 |
| 33 | 0.4840 | 13.835 | 1.5477 | Grit blast | 4.172 |
| 34 | 0.4943 | 13.842 | 1.5490 | Grit blast | 4.139 |
| 35 | 0.4877 | 13.838 | 1.5268 | Grit blast | 5.852 |
| 36 | 0.4890 | 13.810 | 1.5222 | Grit blast | 3.608 |
| 37 | 0.4882 | 13.825 | 1.5562 | Grit blast | 7.111 |
| 38 | 0.4795 | 13.815 | 1.5635 | Grit blast | 5.631 |

TABLE 2-continued

| Sample # | Avg. Via Width (mm) | Via Length (mm) | Avg. Edge of Chip to Via (mm) | Via type | 3 Point Bend Strength (lbs) |
|---|---|---|---|---|---|
| 39 | 0.4855 | 13.811 | 1.5485 | Grit blast | 5.572 |
| 40 | 0.4855 | 13.827 | 1.5522 | Grit blast | 5.671 |
| Average 3 point bend Strength (lbs) for Grit Blast vias | | | | | 5.304 |

As seen in Table 1, silicon chips made with ink vias using the DRIE methods according to the invention exhibited higher torsional strength compared to similar sized vias made by grist blasting techniques. A more dramatic comparison of the strength between chips containing grit blast vias and chips containing DRIE vias is seen in Table 2. This table compares the 3 point bending strength of such chips. As seen by comparing the average strength of each type of chip, chips containing vias made by the DRIE technique exhibited more than about 4 times the strength of chips containing grit blast vias. The increased strength of vias made by DRIE techniques is significant and quite unexpected.

Methods for reactive ion etching are described in U.S. Pat. No. 6,051,503 to Haynes et al., incorporated herein by reference as if fully set forth. Useful etching procedures and apparatus are also described in EP 838,839 to Bhardwaj et al., WO 00/26956 to Bhardwaj et al. and WO 99/01887 to Guibarra et al. Etching equipment is available from Surface Technology Systems Limited of Gwent, Wales.

Having described various aspects and embodiments of the invention and several advantages thereof, it will be recognized by those of ordinary skills that the invention is susceptible to various modifications, substitutions and revisions within the spirit and scope of the appended claims.

What is claimed is:

1. A method for making ink feed vias in semiconductor silicon substrate chips for an ink jet printhead comprising applying an etch stop layer to a first surface of the silicon chip having a thickness ranging from about 300 to about 800 microns, dry etching one or more ink vias through the thickness of the silicon chip up to the etch stop layer from a surface opposite the first surface and forming one or more through holes in the etch stop layer by a mechanical technique, each through hole corresponding to a via of the one or more vias in order to individually fluidly connect the one or more through holes with the corresponding ink vias, whereby substantially vertical wall vias are etched through the thickness of the silicon chip.

2. The method of claim 1 wherein the ink vias have a diameter width or length ranging from about 5 to about 800 microns.

3. The method of claim 1 wherein the etch stop layer is applied with a thickness ratio of etch stop layer to silicon chip ranging from about 1:10 to about 1:800 based on the thickness of the silicon chip.

4. The method of claim 1 wherein the dry etching is conducted while cycling between an etching plasma and a passivation plasma.

5. The method of claim 4 wherein the etching plasma comprises a plasma derived from a gas selected from the group consisting of sulfur hexafluoride ($SF_6$), tetrafluoromethane ($CF_4$) and trifluoroamine ($NF_3$).

6. The method of claim 5 wherein the etching plasma comprises a plasma derived from $SF_6$.

7. The method of claim 4 wherein the passivation plasma comprises a plasma derived from a gas selected from the group consisting of trifluoromethane ($CHF_3$), tetrafluoroethane ($C_2F_4$), hexafluoroethane ($C_2F_6$), difluoroethane ($C_2H_2F_2$), octofluorobutane ($C_4F_8$) and mixtures thereof.

8. The method of claim 7 wherein the passivation plasma comprises a plasma derived from $C_4F_8$.

9. The method of claim 1 wherein the dry etching is selected from deep reactive ion etching (DRIE) and inductively coupled plasma (ICP) etching techniques.

10. The method of claim 1 further comprising chemically etching a trench in the surface opposite the first surface of the silicon chip to a depth ranging from about 50 to about 300 microns to fluidly connect at least a portion of the ink vias to one another prior to dry etching the ink vias in the chip.

11. The method of claim 10 wherein the chemical etching comprises anisotropically etching the silicon chip using a wet chemical etchant selected from the group consisting of potassium hydroxide, hydrazine, ethylenediamine-pyrocatechol-$H_2O$ and tetramethylammonium hydroxide.

12. An ink jet printhead comprising a nozzle plate attached to a silicon chip made by the method of claim 11.

13. The method of claim 1 further comprising chemically etching a trench in the surface opposite the first surface of the silicon chip to a depth ranging from about 50 to about 300 microns to fluidly connect at least a portion of the ink vias to one another subsequent to dry etching ink vias in the chip.

14. An ink jet printhead comprising a nozzle plate attached to a silicon chip made by the method of claim 1.

15. A silicon chip for an ink jet printhead comprising a device layer and a substrate layer, the device layer having a thickness ranging from about 1 to about 4 microns and the substrate layer having a thickness ranging from about 300 to about 800 microns, the device layer having an exposed surface containing a plurality of heater resistors defined by conductive, resistive, insulative and protective layers deposited on the exposed surface thereof, the silicon chip including at least one ink feed via corresponding to one or more of the heater resistors, the at least one ink feed via being formed by dry etching through the substrate layer and having at least one through hole corresponding to each via opened in the device layer by mechanical means so that the at least one through hole individually fluidly connects with the corresponding ink feed via.

16. The silicon chip of claim 15 further comprising a protective layer attached to the substrate layer opposite the device layer.

17. The silicon chip of claim 16 wherein the protective layer has a thickness ranging from about 1 to about 30 microns.

18. The silicon chip of claim 16 further comprising an ink feed via trench chemically etched through the thickness of the protective layer and etched part way through the thickness of the substrate layer providing ink flow communication between at least a portion of the one or more ink feed vias.

19. The silicon chip of claim 18 wherein the trench has a depth ranging from about 50 to about 300 microns.

20. The silicon chip of claim 15 further comprising an ink feed via trench chemically etched part way through the thickness of the substrate layer providing ink flow communication between at least a portion of the ink feed vias.

21. The silicon chip of claim 20 wherein the trench has a depth ranging from about 50 to about 300 microns.

22. An inkjet printhead comprising a nozzle plate attached to the silicon chip of claim 21.

23. The silicon chip of claim 15 wherein the chip contains at least one via for 2, 3 or 4 heater resistors.

24. The silicon chip of claim 15 wherein the chip contains an elongate ink via for feeding ink to all of the heater resistors on the chip.

25. A method for making ink feed vias in semiconductor silicon substrate chips for an ink jet printhead comprising applying a photoresist layer to a first surface of the silicon chip having a thickness ranging from about 300 to about 800 microns, patterning the photoresist layer with a photomask to define one or more ink feed via locations through the silicon chip, and dry etching one or more ink vias through the thickness of the silicon chip in the one or more ink via locations, whereby substantially vertical wall vias are etched through the thickness of the silicon chip.

26. The method of claim 25 wherein multiple ink vias are etched through the silicon chip and the ink vias have a diameter ranging from about 10 to about 200 microns.

27. The method of claim 25 wherein the dry etching is conducted while cycling between an etching plasma and a passivation plasma.

28. The method of claim 27 wherein the etching plasma comprises a plasma derived from $SF_6$.

29. The method of claim 27 wherein the passivation plasma comprises a plasma derived from $C_4F_8$.

30. The method of claim 25 wherein the dry etching is selected from deep reactive ion etching (DRIE) and inductively coupled plasma (ICP) etching techniques.

31. The method of claim 25 further comprising chemically etching a trench in the surface opposite the first surface of the silicon chip to a depth ranging from about 50 to about 300 microns to fluidly connect at least a portion of the one or more ink vias to one another prior to dry etching the one or more ink vias in the chip.

32. The method of claim 31 wherein the chemical etching comprises anisotropically etching the silicon chip using a chemical etchant selected from the group consisting of potassium hydroxide, hydrazine, ethylenediamine-pyrocatechol-$H_2O$ and tetramethylammonium hydroxide.

33. The method of claim 25 wherein the chip contains an elongate ink via.

34. An ink jet printhead comprising a nozzle plate attached to a silicon chip made by the method of claim 25.

* * * * *